US005998112A

United States Patent [19]

Yamashita

[11] Patent Number: 5,998,112

[45] Date of Patent: Dec. 7, 1999

[54] DEVELOPER FOR SILVER HALIDE LIGHT SENSITIVE PHOTOGRAPHIC MATERIAL AND PROCESSING METHOD BY USE THEREOF

[75] Inventor: Hirobumi Yamashita, Hino, Japan

[73] Assignee: Konica Corporation, Tokyo, Japan

[21] Appl. No.: 09/067,270

[22] Filed: Apr. 27, 1998

[30] Foreign Application Priority Data

May 9, 1997 [JP] Japan ..... 9-119334

[51] Int. Cl.[6] ..... G03C 5/305

[52] U.S. Cl. ..... 430/465; 430/480; 430/483; 430/486; 430/490

[58] Field of Search ..... 430/465, 480, 430/483, 486, 490

[56] References Cited

U.S. PATENT DOCUMENTS

| | | | |
|---|---|---|---|
| 3,865,591 | 2/1975 | Katz | 430/437 |
| 4,427,762 | 1/1984 | Takahashi et al. | 430/478 |
| 4,816,384 | 3/1989 | Fruge et al. | 430/465 |
| 5,460,919 | 10/1995 | Obi et al. | 430/490 |
| 5,821,041 | 10/1998 | Okutsu et al. | 430/490 |
| 5,834,171 | 11/1998 | Suzuki et al. | 430/465 |

FOREIGN PATENT DOCUMENTS

| | | |
|---|---|---|
| 0 082 015 | 6/1983 | European Pat. Off. . |
| 0 785 467 A1 | 7/1997 | European Pat. Off. . |
| 0 795 782 A2 | 9/1997 | European Pat. Off. . |
| 2 290 625 | 1/1996 | United Kingdom . |

OTHER PUBLICATIONS

*Research Disclosure,* "An Ascorbic Acid Developer in Various Photographic Applications" (1995) Mar., pp. 185–224, No. 371.

Derwent Publications Ltd., Section Ch, Week 9741, An 97–439545 XP002075521 of JP 09 197 629 A.

*Primary Examiner*—Hoa Van Le

*Attorney, Agent, or Firm*—Frishauf, Holtz, Goodman, Langer & Chick, P.C.

[57] ABSTRACT

A photographic developer composition is disclosed, comprising a reductone, as a developing agent and a compound represented by the following formula (1). The reductone is a compound represented by following formula (A). The processing method by use of the developer composition is also disclosed.

formula (1)

formula (A)

10 Claims, No Drawings

DEVELOPER FOR SILVER HALIDE LIGHT SENSITIVE PHOTOGRAPHIC MATERIAL AND PROCESSING METHOD BY USE THEREOF

FIELD OF THE INVENTION

The present invention relates to a developer for a silver halide light sensitive material (hereinafter, also simply referred to as a photographic material), and in particular, a developer for a photographic material which is superior in silver image tone and is stable in photographic performance, and a processing method by use thereof.

BACKGROUND OF THE INVENTION

Recently, reduction of processing effluent is required for environmental protection. Hydroquinones which have been conventionally employed as a developing agent are unacceptable in terms of safety so that ascorbic acids and their derivatives (e.g. reductones) were studied as substitutes for the hydroquinones. However, the ascorbic acids have the disadvantage of lowering the pH of a developer due to aerial oxidation, resulting in retarding development reaction and lowering development activity. Therefore, it causes the problem in that it is technically difficult to maintain the pH at low replenishing rates.

Developers are generally supplied in the form of a concentrated solution or powder, which are diluted with or dissolved in water to make a developing solution. During the storage, the concentrated solution or solid processing chemicals are subject to oxidation by oxygen in ambient air. The oxidation causes lowering of the concentration of the developing agent or preservatives, or lowering the p H, resulting in deterioration of developability after storage. Thus, the concentrated solution or solid processing chemicals are subject to deterioration during long-term storage so that a technique whereby no deterioration in developability occurs even when kept over a long term, is desired. Further, there is desired development a developer exhibiting stable photographic performance without variation in processing, even when subjected to continuous processing over a long term.

U.S. Pat. No. 1,420,656 and JP-A 54-3532 (herein, the term "JP-A" refers to unexamined and published Japanese Patent Application), for example, disclose a technique which prevents oxidation of the developing solution, in which an amine compound is incorporated as an antioxidant for a color developing agent. However, there is not disclosed a technique for preventing pH- lowering due to oxidation of a developing solution containing ascorbic acid (reductones), as a developing agent, and maintaining development activity. The use of a large amount of the carbonate buffer is known as a technique for maintaining the pH of the developing solution, and an increased addition of a sulfite or addition of a preservative is known as a technique for maintaining the activity. These techniques, however, are insufficient to maintain the pH, and are not preferable since the salt concentration of the developing solution is increased, lowering developability.

SUMMARY OF THE INVENTION

Accordingly, it is an object of the present invention to provide a developer composition for processing a silver halide light sensitive photographic material, whereby, in a developing solution containing a reductone, as a developing agent, no lowering of the pH of the developing solution occurs even when processed at a low replenishing rate;

storage stability of the concentrated solution and running processability are superior and stable photographic performance is obtained without process variation; and a processing method by use thereof.

The above object was accomplished by the following constitution:

(1) a developer composition for use in a silver halide light sensitive photographic material, characterized in that the developer comprises a reductone and a compound represented by the following formula (1):
Formula (1)

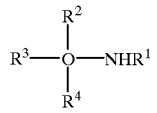

wherein $R^1$ represents a hydrogen atom or a methyl group; $R^2$, $R^3$ and $R^4$ each represent independently a hydrogen atom, an alkyl group having 1 to 3 carbon atoms, a hydroxyalkyl group, a carboxyalkyl group, a sulfoalkyl group or carboxy group;

(2) the developer composition for use in a silver halide light sensitive photographic material described in (1), characterized in that $R^1$ in formula (1) represents a hydrogen atom;

(3) the developer composition for use in a silver halide light sensitive photographic material described in (1), characterized in that the compound represented by formula (1) is a compound represented by formula (2):
Formula (2)

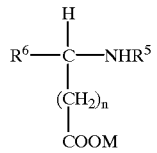

wherein $R^5$ and $R^6$ each represents a hydrogen atom, a methyl group, a hydroxymethyl group or a carboxymethyl group; M represents a hydrogen atom, an alkaline metal atom or an ammonium group; and n is an integer of 0, 1 or 2;

(4) the developer for use in a silver halide light sensitive photographic material described in any one of claims 1 to 3, characterized in that the reductone is a compound represented by the following formula (A):
Formula (A)

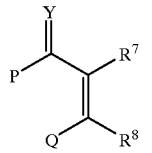

wherein $R^7$ and $R^8$ each represent a hydroxy group, an amino group, an acylamino group, an alkylsulfonylamino group, arylsulfonylamino group, an alkoxycarbonylamino group, a mercapto group or alkylthio group; P and Q each represent a hydroxy group, carboxy group, alkoxy group, hydroxyalkyl group, carboxyalkyl group, a sulfo group, a sulfoalkyl group, an amino group, an aminoalkyl group, an alkyl group or aryl group, or P and Q each represent a nonmetallic atom group and combine with each other to form a 5 to 8-membered ring containing two carbon atoms of the vinyl group substituted by $R^7$ and $R^8$ and the carbon atom substituted by Y.; Y represents =O or =NR, in which R represents a hydrogen atom, a hydroxy group, an alkyl group, an acyl group, a hydroxyalkyl group, a sulfoalkyl group or a carboxyalkyl group;

(5) a method for processing a silver halide light sensitive photographic material, characterized in that the photographic material is processed in the presence of a reductone and a compound represented by formula (1) and/or formula (2) described above;

(6) a method for processing a silver halide light sensitive photographic material, characterized in that the photographic material is processed by use of the developer composition described in any one of (1) to (4);

(7) the method for processing a silver halide light sensitive photographic material described in claim 5 or 6, characterized in that the photographic material is processed by use of an automatic processor, the processing method satisfying the following requirement (L):

$$0.03 \leqq R/V \leqq 0.11 \quad \text{(L)}$$

wherein R represents a replenishing amount per day (1/day) and V represents a volume of a developing tank of the processor.

DETAILED DESCRIPTION OF THE INVENTION

In the developer composition according to the invention are employed reductones as a developing agent. The reductones include ene-diol type, enaminol type, ene-diamine type, thiolenol type and enamine-thiol type. Of these, compounds represented by formulas (A) are preferred.

In the formula (A), $R^7$ and $R^8$ each represent a hydroxy group, an amino group (which may be substituted by an alkyl group such as ethyl, butyl or hydroxybutyl), an acylamino group (e.g. acetylamino, benzoylamino), an alkylsulfonylamino group (e.g. methanesulfonylamino, butanesulfonylamino), arylsulfonylamino group (e.g. benzenesulfonylamino, p-toluenesulfonylamino), an alkoxycarbonylamino group (e.g. methoxycarbonylamino), a mercapto group or alkylthio group (e.g. methylthio, ethylthio). Of these are preferred a hydroxy group, amino group, an alkylsulfonylamino group, and arylsulfonylamino group.

P and Q each represent a hydroxy group, alkoxy group (e.g. methoxy, ethoxy, butoxy), hydroxyalkyl group (e.g. hydroxymethyl, hydroxyethyl), carboxyalkyl group (e.g. carboxymethyl, carboxyethyl), a sulfo group (including its salt), a sulfoalkyl group (e.g. sulfoethyl, sulfopropyl), an amino group (including alkyl-substituted one), an aminoalkyl group (e.g. aminoethyl, aminopropyl), an alkyl group (e.g. methyl, ethyl, propyl, butyl, pentyl) or aryl group (e.g. phenyl, p-tolyl, naphthyl), or P and Q each represent a nonmetallic atom group, which combine with each other to form a 5 to 8-membered ring containing two carbon atoms of the vinyl group substituted by $R^7$ and $R^8$ and the carbon atom substituted by Y. The 5 to 8-membered ring may further form a saturated or unsaturated condensed ring. Examples of the 5 to 8-membered ring include a dihydroxyfuran ring, dihydroxypyrone ring, a pyranone ring, a cyclopentenone ring, a pyrrolinone ring, a pyrazolinone ring, a pyridone ring, an azacyclohexenone ring, a uracil ring, a cycloheptenone ring, a cyclohexanone ring, an azepine ring and a cyclooctenone ring, and of these, a 5- or 6-membered ring is preferred. Furthermore are preferred a dihydoxyfuran ring, cyclopentenone ring, cyclohexanone ring, pyrazolinone ring, azacyclohexenone and uracil ring.

When Y represents $=NR^9$, $R^9$ represents a hydrogen atom, a hydroxy group, an alkyl group, an acyl group, a hydroxyalkyl group, a sulfoalkyl group or a carboxyalkyl group, and examples thereof are the same as shown in above $R^7$, $R^8$, P and Q.

Exemplary examples of the compound represented by formula (A) are shown below, but they not limited to these examples.

A-1

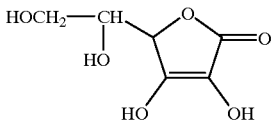

A-2

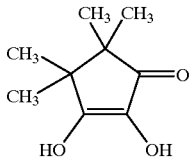

A-3

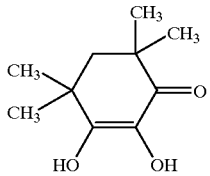

A-4

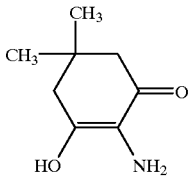

A-5

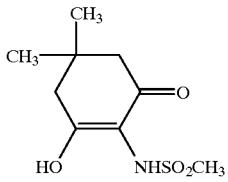

A-6

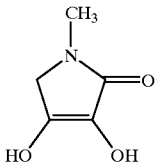

A-7

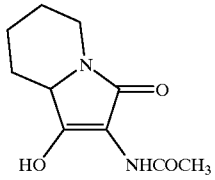

-continued

A-8

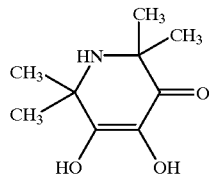

A-9

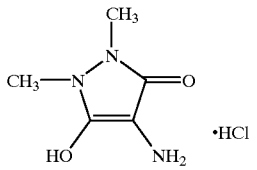

A-10

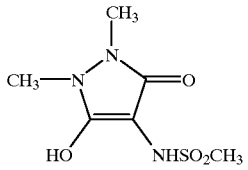

A-11

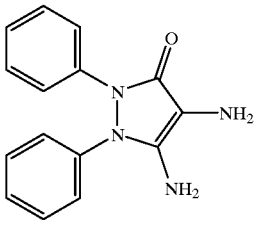

A-12

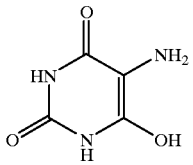

A-13

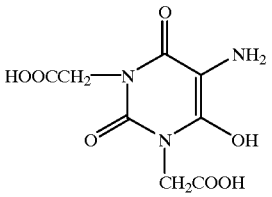

A-14

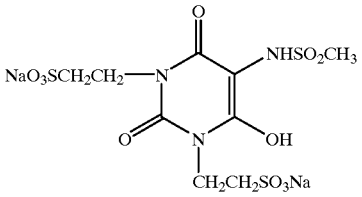

A-15

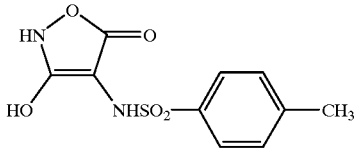

-continued

A-16

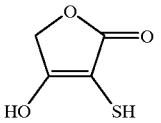

A-17

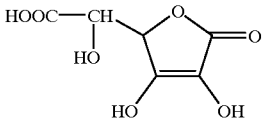

A-18

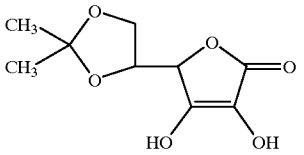

A-19

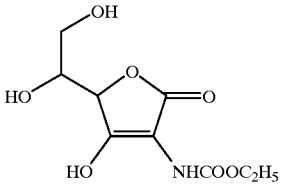

A-20

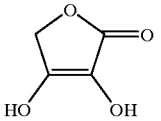

A-21

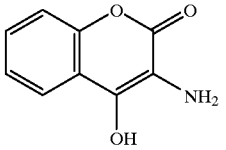

A-22

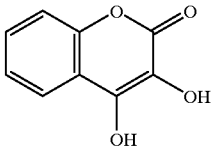

The salts of the reductones include those of lithium, sodium, potassium and ammonium. Of these reductones is preferred ascorbic acid (A-1) including its stereoisomer, erythorbic acid. The addition amount of the reductone into a developing solution is not specifically limitative, and preferably, 0.1 to 100 g, more preferably 0.5 to 60 g, and still more preferably 1 to 30 g per liter of a developing solution, in terms of preventing formation of white precipitates. The reductone is contained singly or in combination of two or more thereof.

The compound represented by formula (1) which is employed together with the reductone, will be further explained.

In the formula (1), $R^1$ is a hydrogen atom or a methyl group. $R^2$, $R^3$ and $R^4$ each are a hydrogen atom or a substituted or unsubstituted alkyl group having one to three carbon atoms. The substituted alkyl group is selected from a hydroxyalkyl group, a carboxyalkyl group, sulfoalkyl group and carboxyalkyl group. $R^2$, $R^3$ and $R^4$ each are preferably a hydroxyalkyl, carboxyalkyl or sulfoalkyl group, in terms of reducing odor. Further, $R^1$ is preferably a hydrogen atom.

The compound represented by formula (1) is more preferably a compound represented by formula (2). In the formula (2), $R^5$ and $R^6$ are selected from a hydrogen atom, a methyl group, a hydroxymethyl group and a carboxymethyl group. $R^5$ and $R^6$ each are not substituted by —SH group. M is a hydrogen atom, an alkaline metal atom or ammonium, but when this compound is present in a developing solution, M is dissociated and the compound is contemplated to exist in the form of an anion. n is 0, 1 or 2, and when n is 0, effects of the invention is highest and as the number increases, the effects are decreased.

Exemplary examples of the compounds represented by formulas (1) and (2) are shown below, but the compounds are not limited to these examples.

1-1

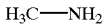

1-2

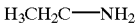

1-3

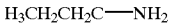

1-4

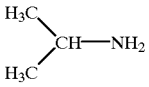

1-5

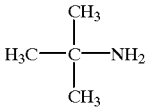

1-6

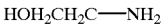

1-7

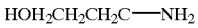

1-8

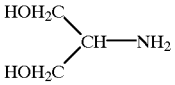

1-9

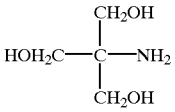

1-10

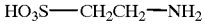

1-11

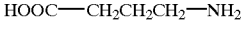

1-12

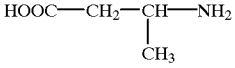

1-13

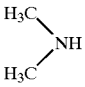

1-14

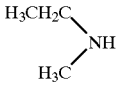

-continued 1-15

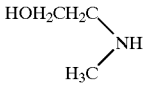

2-1

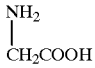

2-2

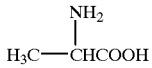

2-3

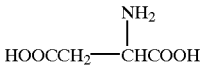

2-4

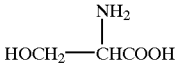

2-5

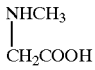

2-6

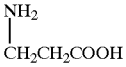

2-7

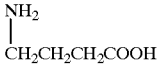

2-8

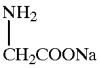

2-9

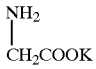

2-10

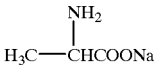

2-11

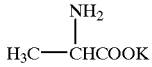

2-12

2-13

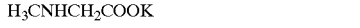

2-14

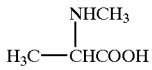

These compounds are known in the art and can be readily obtained through synthesis or extraction. Of these compounds are preferred compounds (2-1), (2—2) and (2-5). The adding amount of the compound represented by formula (1) or (2) into a developing solution is not specifically limitative, but preferably 0.01 to 1.5 mol, and more preferably 0.05 to 1 mol per liter of a developer. The compound represented by formula (1) or (2) is employed singly or in combination of the compound represented by formula (1) with the compound represented by formula (2).

In the processing method according to the invention, relationship between a replenishing amount of a developing solution and a volume of a developing tank, preferably falls within the range represented by the following equation (L):

$$0.03 \leqq R/V \leqq 0.11 \quad (L)$$

where V: volume of a developing tank of a processor (1)

R: replenishing amount of a developing solution per day (1).

The developing tank refers to a bath containing a developing solution into which a photographic material is dipped, when developed in an automatic processor. The replenishing amount of a developing solution refers to the volume of a fresh developing solution which is replenished into the developing tank containing an exhausted developing solution. According to the invention, when the value of R/V falls within the range described above, effects of the invention is preferably displayed.

Next, developing solutions relating to the invention will be further described.

The developer used in the invention may contain a developing agent other than the reductones, such as the compound represented by formula (1). Examples thereof include substituted dihydroxybenzenes (e.g. potassium hydroquinonemonosulfonate, sodium hydroquinonemonosulfonate, potassium hydroquinonedisulfonate, sodium hydroquinonedisulfonate); 3-pyrazolidones (e.g. 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, 1-phenyl-4-methyl-4-hydroxy-3-pyrazolidone, 1-phenyl-4,4-dihydroxymethyl-3-pyrazolidone, 1-p-tolyl-3-pyrazolidone, 1-phenyl-2-acetyl-4,4-dimethyl-3-pyrazolidone, 1-(2-benzothiazole)-3-pyrazolidone, 3-acetoxy-1-phenyl-3-pyrazolidone); aminophenols (e.g. o-aminophenol, p-aminophenol, N-methyl-o-aminophenol, N-methyl-p-aminophenol, 2,4-diaminophenol); 1-allyl-3-aminopyrazolines {e.g. 1-(p-hydroxyphenyl)-3-aminopyrazoline, 1-(p-methylaminophenyl)-3-aminopyrazoline, 1-(p-amino-m-methylphenyl)-3-aminopyrazoline}; pyrazolones (e.g. 4-aminopyrazolone) and a mixture thereof. Of pyrazolidones are preferred 4-substituted ones, e.g. Dimezone and Dimezone-S, which are aqueous-soluble and little variation in aging in the form of a solid composition.

The developer (solution) may optionally contain a preservative (e.g. sulfite, bisulfite), a buffering agent (e.g. a carbonate, borate, saccharide, phosphate), an alkaline agent (e.g. sodium hydroxide, potassium hydroxide, lithium hydroxide, sodium carbonate, potassium carbonate), a dissolution aid (e.g. polyethylene glycols and their esters), a pH-adjusting agent (e.g. organic acids such as citric acid and tartaric acid), a sensitizer (e.g. a quaternary ammonium), a development-accelerating agent, a hardening agent (e.g. dialdehydes such as glutar aldehyde) or a surfactant. There may be added a fog inhibitor, such as azole type organic fog inhibitor (including an indazole type, imidazole type, benzoimidazole type, triazole type benzotriazole type, tetrazole type, thiadiazole type) or a sequestering agent for sequestering calcium ion contained in tap water (e.g. sodium hexametaphosphate, calcium metaphosphate, polyphosphate). Compounds described in JP-A 56-24347 and 4-362942 and JP-B 56-46585 and 62-2849 may be employed as an anti-silver-staining agent (herein, the term "JP-B" refers to examined and published Japanese Patent). The developer may further contain compounds described in L.F.A. Mason "Photographic Processing Chemistry" published by Focal Press (1966) pages 22–229; U.S. Pat. Nos. 2,193,015 and 2,592,364; and JP-A 48-64933.

The pH of the developing solution used in the invention is preferably 9 to 12 and more preferably 9.5 to 10.5.

Next, a fixer (solution) used in the invention will be further described. A fixing solution used in the invention contains preferably a thiosulfate, as a fixing agent. The thiosulfate is conventionally employed in the form of its lithium, sodium, potassium or ammonium salt; of these are preferably employed sodium thiosulfate or ammonium thiosulfate, and an ammonium salt is preferred in terms of the fixing speed and a sodium salt is more preferred in terms of stability. The concentration of the thiosulfate is preferably 0.1 to 5 mol/l, more preferably 0.5 to 2 mol/l and still more preferably 0.7 to 1.8 mol/l. An iodide or a thiocyanate can also employed as a fixing agent. The fixing solution may contain a sulfite. The concentration of the sulfite is 0.2 mol/l or less, when the thiosulfate and sulfite are dissolved in an aqueous solvent. The sulfite is employed in the form of a lithium, sodium, potassium or ammonium salt, which is dissolved with a solid thiosulfate. The fixing solution may contain an aqueous soluble chromium salt or an aqueous soluble aluminum salt. Examples of the aqueous soluble chromium include chromium alum, and examples of the aqueous soluble aluminum salt include aluminum sulfate, potassium aluminum chloride and aluminum chloride. The chromium salt or aluminum salt is contained preferably in an amount of 0.2 to 3.0 g, and more preferably 1.2 to 2.5 g per liter of a fixing solution.

The fixing solution may further contain acetic acid, citric acid, tartaric acid, malic acid, succinic acid, phenylacetic acid and their optical isomers. Lithium, sodium, potassium and ammonium salts of these acids are preferably employed, including potassium citrate, lithium citrate, sodium citrate, ammonium citrate, lithium hydrogentartarate, potassium hydrogeritartarate, potassium tartarate, sodium hydrogentartarate, sodium tartarate, ammonium hydrogentartarate, ammonium potassium tartarate, potassium sodium tartarate, sodium malate, ammonium malate, sodium succinate and ammonium succinate. Of these are preferred acetic acid, citric acid, isocitric acid, malic acid, phenylacetic acid and their salts. These acids or their salts are preferably contained in an amount of 0.2 to 0.6 mol/l. Inorganic acids such as sulfuric acid hydrochloric acid, nitric acid and boric acid, and organic acids such as formic acid, propionic acid, oxalic acid and malic acid may also be employed, and boric acid, amino(poly)carboxylic acids and their salts are preferably employed. Particularly preferred aminocarboxylic acids include β-alanine and piperidinecarboxylic acid. These acids are contained preferably in an amount of 0.5 to 40 g/l. A chelating agent may be contained, including aminopolycarboxylic acids such as nitrilotriacetic acid and ethylenediaminetetraacetic acid and their salts. There may be contained a surfactant such as an anionic surfactant including a sulfate ester and sulfonate, a nonionic surfactant including a polyethylene glycol type and ester type and an amphoteric surfactant described in JP-A 57-6840; an wetting agent such as an alkanol amine and alkylene glycol; and a fix-accelerating agent such as thioureas described in JP-A 45-35754 and JP-B 58-122535 and 58-122536, an alcohol which has a triple bond within the molecule, a thioether described in U.S. Pat. No. 4,126,459. The pH of a fixing solution is conventionally 3.8 or higher, and preferably 4.2 to 5.5.

The developer or fixer used in the invention is provided preferably in the form of a concentrated solution or in a solid form. In cases where the developer composition according to the invention is in the form of a concentrated solution, the reductone according to the invention is contained preferably in an amount of 0.5 to 250 g/l and more preferably 2 to 150 g/l, and the compound represented by formula (1) or (2) is contained preferably in an amount of 0.02 to 4.0 mol/l and more preferably 0.1 to 2.5 mol/l. Furthermore, in cases where the developer composition is in a solid, the reductone is contained preferably in an amount of 3 to 90% by weight and more preferably 10 to 80% by weight, based on the solid composition; and the compound represented by formula (1) or (2) is contained preferably in an amount of $10^{-4}$ to $3\times10^{-3}$ mol and more preferably $3\times10^{-4}$ to $2\times10^{-3}$ mol per g of the solid composition.

The processing composition can be solidified in such a manner that the processing composition in the form of a concentrated solution, fine powder or granules is mixed with a water soluble bonding agent and then the mixture is molded, or the water soluble bonding agent is sprayed on the surface of temporarily-molded processing composition to form a covering layer, as described in JP-A 4-29136, 4-85533, 4-85534, 4-85535, 4-85536 and 4-172341.

When the developer or fixer is provided in the form a tablet in the invention, saccharides including monosaccharides, polysaccharides and their decomposition product, as described in JP-A 7-295161 (pages 9–11) are preferably employed as a binder, and of these are preferably employed dextrins and sugar alcohols. were improved variation in form during long-term storage, occurrence of troubles at the time of addition and ease of use.

Acylated amino acids described in JP-A 7-92624 (page 9–15) are preferably employed, as a lubricant, in the solid processing composition, whereby the solid processing composition can be stably prepared without deteriorating the strength, deterioration in solubility is little and storage stability and dust formation are improved. Further, organic sulfur compounds described in Japanese patent Application No. 8-4764 (page 19–21) are also preferred. In the solid processing composition is also employed a coating agent, such as hydroxylamines, phenylcarboxylic acids, phenylsulfonic acids, hydroxy or carboxy-introduced alkyl(or alkenyl) carboxylic acids, sulfites, water-soluble polymers (e.g. polyalkylene glycols, methacryl betaine-type polymers) and saccharides. Thereby, stable photographic performance can be kept along with little production of fine powder, little deterioration in solubility and superior storage stability.

Photographic materials used in the invention are not limitative. The photographic materials can be prepared by means known in the photographic art. Photographic emulsions used in the photographic material can be prepared according to the methods known in the art, as described in Research Disclosure (RD) 17643 (December 1978) page 22–23, Sect. I "Emulsion Preparation and Types"; RD 18716 (November 1979) page 648; T. H. James "The Theory of the Photographic Process" 4th ed., Macmillan Publishing Co. (1977) page 38–104; G. F. Duffin "Photographic Emulsion Chemistry", Focal Press Co. (1966), P. Glafkides "Chimie et physique photographique", Paul Montel (1967); and V. L. Zelikman et al. "Making and Coating Photographic Emulsion" Focal Press Co. (1964).

Preferred silver halide emulsions include an internally high iodide-containing, monodispersed grain emulsion described in JP-A 59-177535, 61-802237, 61-132943, 63-49751 and 2-85846. Silver bromochloride or silver chloride containing chloride of 50 mol % or more are also preferably employed. With regard to the crystal structure of silver halide is preferably employed a core/shell type monodisperse emulsion grains having two layer comprised of a high iodide core and low iodide shell, in which the iodide content of the high iodide portion is preferably 20 to 40 mol % and more preferably 20 to 30 mol %, as exemplified in J. Phot. Sci. 12, 242–251 (1963), JP-A 48-36890, 52-16364, 56-142329, 58-49938; British Patent 1,413,748 and 1,027,146; U.S. Pat. Nos. 3,574,628, 3,655,394, 3,505,068, and 4,444,877 and JP-A 60-14331. A silver halide emulsion preferably employed in the invention is comprised of tabular grains having an average aspect ratio of 1 or more. Advantages of the tabular grains concern improvements in spectral sensitization efficiency, image graininess and sharpness, as described in British Patent 2,112,157; U.S. Pat. Nos. 4,439,520, 4,433,048, 4,414,310 and 4,434,226; JP-A 58-113927, 58-127921, 63-138342, 63-284272 and 63-305343. The emulsion can be prepared according to the method described in the above references.

In these emulsions may be contained a cadmium salt, lead salt, zinc salt, thallium salt, iridium salt including its complex salt, rhodium salt including its complex salt, or a iron salt including its complex salt at the stage of grain formation or physical ripening. The emulsion may be subjected to washing to remove soluble salts, such as noodle washing or flocculation process. Preferred washing includes the method by use of a sulfo group-containing aromatic hydrocarbon type aldehyde resin described in JP-B 35-16086 and the method by use of a polymeric coagulating agent, G3 or G8 described in JP-A 63-158644. The silver halide emulsion can be chemically ripened by the use of gold sensitization, sulfur sensitization, reduction sensitization or chalcogen sensitization, singly or in combination thereof.

A variety of photographic adjuvants may be incorporated to the emulsion before, during, or after physical or chemical ripening. There may be incorporated, as a contrast-increasing agent, a hydrazine compound or tetrazolium compound. A nucleation accelerating agent may also be employed. Furthermore, examples of known adjuvants include those described in RD 17643 (December 1978) page 23–29; Rd 18716 (December 1979) page 648–651; RD 308119 (December 1989) page 996–1009.

Supports usable in photographic materials are described in RD 17643 page 28 and RD 308119 page 1009. Suitable supports include plastic resin films The surface of the support may be provided with a sub-layer or subjected to corona discharge or UV ray exposure to improve adhesive property. Further, a cross-over cut layer or antistatic layer may be provided thereon. Emulsion layer(s) may be provided on one side or both sides of the support. When being provided on both sides, photographic performance may be the same or different in both sides.

EXAMPLES

Example 1

To evaluate processability with a developer according to the invention, a photographic material was prepared according to the following procedure.

Preparation of Emulsion (EM-1)

| | |
|---|---|
| Solution A | |
| High methionine containing gelatin (methionine 59.7 mg/g gelatin) | 30 g |
| 4,5,6-Triaminopyrimidine | 100 g |
| Sodium chloride | 1054 g |
| Sodium bromide | 68.7 g |
| Distilled water to make | 6000 ml |
| Solution B | |
| Silver nitrate | 1135 g |
| Distilled water to make | 2000 ml |

To a reaction vessel containing Solution A at a pH of 5.6 and maintained at 40° C., 6 ml of Solution B was added in 1 min. and remained Solution B was further added in 55 min. at a linearly accelerated flow rate (9.7 times faster at the end than at the start). At 5 min. and 18 min. after starting the addition were added 400 ml of 4M sodium chloride aqueous solution and 100 ml of 20 mM 4,5,6-triaminopyrimidine solution. During addition of the above solutions, addition of silver salt was interrupted and reaction mixture was uniformly mixed. The pH was constantly maintained by adding sodium hydroxide or nitric acid while the silver salt was added. After completion of the addition, the emulsion was desalted to remove soluble salts according to the conventional method.

Electron microscopic observation of about 3,000 grains of the resulting emulsion (EM-1) revealed that the emulsion was comprised of silver bromochloride tabular grains containing 90 mol % chloride and having an average aspect ratio of 15 (average equivalent circular diameter of 1.80 $\mu$m and average thickness of 0.12 $\mu$m).

Preparation of Photographic Material

To the emulsion (EM-1) were added the following spectral sensitizing dyes SD-1 and SD-2 (in a weight ratio of 20:1) in an amount of 400 mg per mol of silver halide.

SD-1: Anhydro-5,5'-dichloro-9-ethyl-3,3'-di-(3-sulfopropyl)oxacarbocyanine sodium salt SD-1: Anhydro-5,5'-di-(butoxycarbonyl)-1,1'-diethyl-3,3'-di-(4-sulfopropyl)benzoylimidazolocarbocyanine sodium salt After 10 min., an optimal amounts of ammonium thiocyanate, chloroauric acid, sodium thiosulfate and a dispersion of triphenyphosphine selenide were added to perform chemical ripening. At 40 min. before completion of the ripening was added a silver iodide fine grain emulsion with grain size of 0.06 $\mu$m in an amount of $6\times10^{-4}$ mol per mol of silver. When completing the ripening, 4-hydroxy-6-methyl-1,3,3a,7-tetrazaindene (ST-1) of $3\times10^{-2}$ mol per mol of silver was added and then gelatin of 70 g was further added to redisperse the emulsion.

To the emulsion were added the following adjuvants. The addition amount was expressed in per mol of silver halide.

| | |
|---|---|
| 1,1-Dimethylol-1-brom-1-nitromethane | 70 mg |
| t-Butylcatechol | 400 mg |
| Polyvinylpyrrolidone (M.W. 10,000) | 1.0 g |
| Styrene-maleic acid copolymer | 2.5 g |
| Nitrophenyl-triphenylphosphonium chloride | 50 mg |
| Ammonium 1,3-dihydroxybenzene-4-sulfonate | 4 g |
| Sodium 2-mercaptobenzimidazole-5-sulfonate | 15 mg |
| 1-Phenyl-5-mercaptotetrazole | 10 mg |
| Trimethylol propane | 10 g |
| $C_4H_9OCH_2CH(OH)CH_2N(CH_2COOH)_2$ | 1 g |
| Compound A | 60 mg |
| Compound B | 35 mg |

Compound A

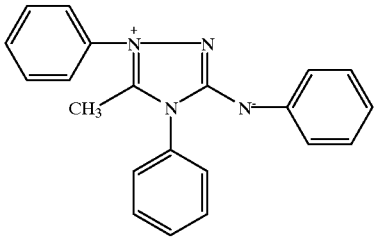

-continued

Compound B

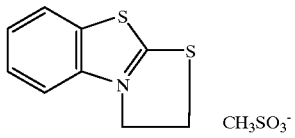

Further thereto was added the following dye-emulsified dispersion of 1.0 g to prepare a emulsion-coating solution. Preparation of dye-emulsified dispersion:

The following dye (F-!9 of 10 kg was dissolved in tricresy phosphate of 28 liters and ethyl acetate of 85 liters at 55° C. (herein, denoted as oil solvent). Separately, there was prepared 9.3% aqueous gelatin solution containing anionic surfactant, sodium tri-i-propylnaphthalenesulfonate (SU-1) of 1.35 kg (denoted as aqueous solvent). The oil solvent and aqueous solvent were added into a dispersion vessel and dispersed, while kept at 40° C. To the resulting dispersion were added optimal amounts of phenol and 1,1'-dimethylol-1-brom-1-nitromethane, and water was further added to make 240 kg of the dye-emulsified dispersion.

F-1

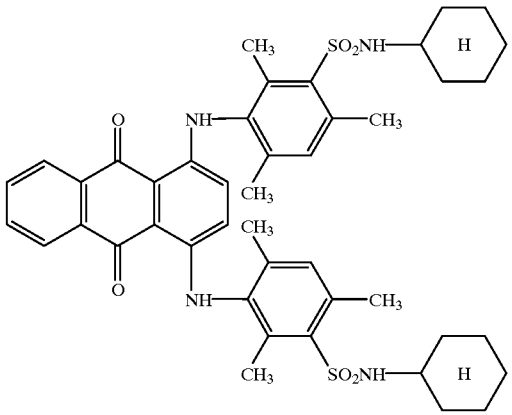

A protective layer-coating solution was prepared by adding the following adjuvants, provided that the amount was per liter of coating solution.

| | |
|---|---|
| Lime-processed inert gelatin | 68 g |
| Acid process gelatin | 2 g |
| Polymethyl methacrylate (matting agent with area-averaged diameter of 3.5 $\mu$m) | 1.1 g |
| Silicon dioxide (matting agent with area-averaged diameter of 1.2 $\mu$m) | 0.5 g |
| Ludox AM (colloidal silica available from du'Pont) | 30 g |
| Glyoxal 40% aqueous solution (hardener) | 1.5 ml |
| $(CH_2{=}CHSO_2CH_2)_2O$ (hardener) | 500 mg |
| $C_{12}H_{25}CONH(CH_2CH_2O)_5H$ | 2.0 g |
| SU-2 (surfactant) | 20 mg |
| SU-3 (surfactant) | 7 mg |
| SU-4 (surfactant) | 7 mg |
| $C_{12}H_{25}CONH(CH_2CH_2O)_6H$ | 62 mg |
| DI-1 (antimold) | 0.9 mg |

-continued

SU-2

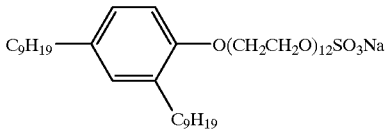

SU-3

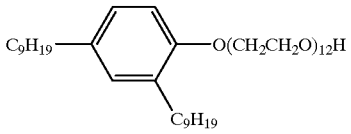

SU-4

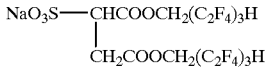

DI-1

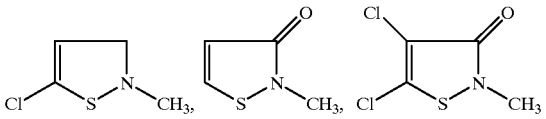

(50:46:4)

On both sides of a blue-tinted polyethylene terephthalate support with a thickness of 175 μm was coated a sub-layer coating solution to form a sublayer having the following composition, in which each amount is expressed per $m^2$.

Sub-layer Coating Solution

| | |
|---|---|
| Dye (F-2) | 30 mg |
| Gelatin | 0.5 g |
| p-Nonylphenoxypolyethyleneoxide (polymerization degree = 10) | 6 mg |
| 1-morphonylcarbonyl-3-(pyridinio)-methanesulphonate | 80 mg |
| Polymethylmethacrylate (matting agent with av. particle size of 2.5 μm) | 2 mg |

F-2

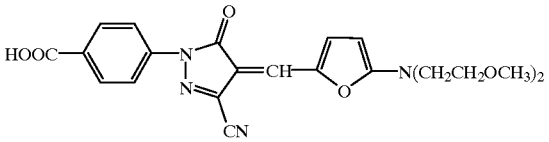

The emulsion layer with a coating weight of silver of 1.8 $g/m^2$ and a coating weight of gelatin of 1.6 $g/m^2$ and a protective layer with a coating weight of 0.9 $g/m^2$ were coated, n both sides of the subbed support, by means of two slide hopper coasting machines at a speed of 90 m/min., and dried for 2 min. 30 sec. to prepare a photographic material sample.

Preparation of Developer and Fixer

Concentrated developing and fixing solutions having the following compositions were prepared, and storage stability of a concentrated developing solution was evaluated, and further, variation in pH and photographic performance in running of a developing solution process were evaluated.

Concentrated developing solution

| | |
|---|---|
| Diethylenetriaminepentaacetic acid | 5 g |
| Sodium sulfite | 24 g |
| Sodium carbonate monohydrate | 87.5 g |
| Potassium carbonate | 97.5 g |
| Sodium erythorbate | 120 g |
| N-acetyl-D, L--penicillamine | |
| 1-Phenyl-4-methyl-4-hydroxymethyl-3-pyrazolidone | 16 g |
| 5-Methylbenzotriazole | 0.15 g |
| Compound of formula (1) or (2), as shown in Table 1 | |
| Glutar aldehyde (50 wt % solution) | 8 g |

Water was added to make 1 liter and the pH was adjusted to 10.20 with KOH. To 400 ml of the developer concentrated solution was added 600 ml of water to make a working solution (Developing solution-1).

Concentrated fixing solution

| | |
|---|---|
| Ammonium thiosulfate (70 wt/vol %) | 400 ml |
| Sodium sulfite | 40 g |
| Boric acid | 16 g |
| β-alanine | 36 g |
| Glacial acetic acid | 60 g |
| Tartaric acid | 5 g |
| Aluminum sulfate | 20 g |

Water was added to make 1 liter and the pH was adjusted to 4.60 with NaOH. To 500 ml of the fixer concentrated solution was added 500 ml of water to make a working solution (Fixing solution-1).

Stability of Concentrated Fixing Solution

The Concentrated developing solution was put in a polyethylene vessel and was allowed to stand at 60° C. for 2 months, and after storage, the pH and photographic performance were each evaluated. Instead of the compounds represented by formula (1) or (2), the following compounds were each added to the developing solution and evaluated.

Comp-1

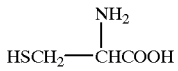

Comp-2

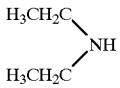

Comp-3

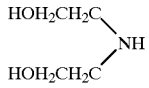

Photographic performance was evaluated as follows. A concentrated developing solution stored and a concentrated fixing solution were each diluted according to the above-described ratio and put into an automatic processor SRX-701 (available from Kcnica Corp.), whereby the photographic material sample was processed in 30 sec. A fresh developing solution was also evaluated to make comparison before and after storage. The developing and fixing temperatures were each 35° C. In Table 1, the sensitivity was defined as a reciprocal of exposure necessary to give an optical density of fog plus 1.0 and shown as a relative value, based on the sensitivity in the case when developed with a fresh developing solution being 100. Fog is an optical density at an unexposed portion including the support and Dm is a maximum density. The liquid volume of a developing tank was adjusted to 13.5 1. Results are shown in Table 1.

TABLE 1

| Developer | Compound (mol/l) | | pH after storage* | Fog | Sensitivity | Dm | Remark |
|---|---|---|---|---|---|---|---|
| 1 | — | | 10.00 | 0.185 | 85 | 3.20 | Comp. |
| 2 | 1-1 | (0.25) | 10.14 | 0.185 | 94 | 3.40 | Inv. |
| 3 | 1-2 | (0.25) | 10.16 | 0.185 | 95 | 3.45 | Inv. |
| 4 | 1-4 | (0.25) | 10.16 | 0.185 | 95 | 3.45 | Inv. |
| 5 | 1-6 | (0.25) | 10.17 | 0.185 | 96 | 3.44 | Inv. |
| 6 | 1-9 | (0.25) | 10.14 | 0.185 | 95 | 3.41 | Inv. |
| 7 | 1-13 | (0.25) | 10.07 | 0.185 | 88 | 3.28 | Inv. |
| 8 | Comp.2 | (0.25) | 10.00 | 0.185 | 85 | 3.20 | Comp. |
| 9 | Comp.3 | (0.25) | 10.00 | 0.185 | 85 | 3.20 | Comp. |
| 10 | 2-1 | (0.25) | 10.19 | 0.185 | 97 | 3.48 | Inv. |
| 11 | 2-2 | (0.25) | 10.18 | 0.185 | 98 | 3.47 | Inv. |
| 12 | 2-3 | (0.25) | 10.17 | 0.185 | 96 | 3.45 | Inv. |
| 13 | 2-4 | (0.25) | 10.18 | 0.185 | 98 | 3.47 | Inv. |

TABLE 1-continued

| Developer | Compound (mol/l) | | pH after storage* | Fog | Sensitivity | Dm | Remark |
|---|---|---|---|---|---|---|---|
| 14 | 2-5 | (0.25) | 10.20 | 0.185 | 100 | 3.50 | Inv. |
| 15 | 2-6 | (0.25) | 10.14 | 0.185 | 95 | 3.45 | Inv. |
| 16 | 2-7 | (0.25) | 10.12 | 0.185 | 93 | 3.42 | Inv. |
| 17 | 2-14 | (0.25) | 10.20 | 0.185 | 100 | 3.50 | Inv. |
| 18 | Comp.1 | (0.25) | 10.30 | 0.182 | 85 | 3.00 | Comp. |

*pH of a fresh solution was 10.20

As can be seen from Table 1, the developer according to the invention was little in pH-variation when being stored in the form of a concentrated solution and exhibited superior photographic performance with respect to the sensitivity and maximum density, as compared to comparative samples.

Next, the photographic material sample was also subjected to running process. Developing solution-1 and Fixing solution-1 were put into the processor, SRX-701 and running process was carried out according to the following conditions. The developing and fixing temperatures were each set to 35° C. and the photographic material was processed every day, in an amount per day shown in Table 2, for 3 weeks, while developing and fixing solutions were each replenished in an amount of 150 ml per $m^2$ of the photographic material. At the time of starting the running process, there were added, as a starter, acetic acid in an amount that caused the pH of the developing solution to be 10.00 and potassium bromide in an amount that gave a concentration of 12.2 g/l., and the resulting fresh developing solution was employed as a starting solution. Results thereof ware shown in Table 2. In the Table, the sensitivity is defined as a reciprocal of exposure necessary to give an optical density of fog plus 1.0 and shown as a relative value, based on the sensitivity in the case when developed with a fresh developing solution which contained no compound represented by formula (1) or (2), being 100. Fog is an optical density at an unexposed portion including the support and Dm is a maximum density. The pH is a pH value of a developing solution after running process. The liquid volume of a developing tank was adjusted to 13.5 l, and the value of R/V was shown in the Table.

TABLE 2

| Developer | Compound (mol/l) | | Proc. amt. ($m^2$/day) | R/V | Fog | Sensitivity | Dm | pH | Remark |
|---|---|---|---|---|---|---|---|---|---|
| 19 | — | | Fresh soln. | | 0.185 | 100 | 3.50 | 10.00 | Comp. |
| 20 | — | | 11.00 | 0.122 | 0.188 | 96 | 3.40 | 9.90 | Comp. |
| 21 | 1-1 | (0.25) | 11.00 | 0.122 | 0.186 | 98 | 3.48 | 9.98 | Inv. |
| 22 | 1-2 | (0.25) | 11.00 | 0.122 | 0.186 | 98 | 3.48 | 9.99 | Inv. |
| 23 | Comp.2 | (0.25) | 11.00 | 0.122 | 0.188 | 96 | 3.40 | 9.90 | Comp. |
| 24 | Comp.3 | (0.25) | 11.00 | 0.122 | 0.188 | 96 | 3.40 | 9.90 | Comp. |
| 25 | 2-1 | (0.25) | 11.00 | 0.122 | 0.186 | 98 | 3.48 | 10.00 | Inv. |
| 26 | 2-5 | (0.25) | 11.00 | 0.122 | 0.186 | 98 | 3.48 | 10.00 | Inv. |
| 27 | Comp.1 | (0.25) | 11.00 | 0.122 | 0.182 | 85 | 3.00 | 10.20 | Comp. |
| 28 | — | | 5.00 | 0.056 | 0.188 | 80 | 3.20 | 9.80 | Comp. |
| 29 | 1-1 | (0.25) | 5.00 | 0.056 | 0.186 | 95 | 3.38 | 9.95 | Inv. |
| 30 | 1-2 | (0.25) | 5.00 | 0.056 | 0.186 | 94 | 3.40 | 9.97 | Inv. |
| 31 | Comp.2 | (0.25) | 5.00 | 0.056 | 0.188 | 80 | 3.20 | 9.80 | Comp. |
| 32 | Comp.3 | (0.25) | 5.00 | 0.056 | 0.188 | 80 | 3.20 | 9.80 | Comp. |
| 33 | 2-1 | (0.25) | 5.00 | 0.056 | 0.185 | 97 | 3.45 | 10.00 | Inv. |
| 34 | 2-5 | (0.25) | 5.00 | 0.056 | 0.185 | 98 | 3.47 | 10.00 | Inv. |
| 35 | Comp.1 | (0.25) | 5.00 | 0.056 | 0.182 | 72 | 3.00 | 10.10 | Comp. |

As can be seen from Table 2, the use of the developer according to the invention led to enhanced running-process stability, and it is further proved that when a mean residence time (day) increased, effects of the invention became marked.

Example 2

Solid developer and fixer compositions were each prepared according to the following procedure, and evaluated with respect to the pH variation of a developing solution and photographic performance in running process.

Preparation of Solid Developer-1

Granules (A)

1-Phenyl-3-pyrazolidone of 500 g, N-actyl-D,L-penicillamine of 10 g, boric acid of 500 g and sodium glutaraldehyde bissulfite of 1,000 g each were pulverized up in a commercially available mill so as to have an average particle size of 10 $\mu$m. To the resulting fine particles, were added DTPA.5Na (pentasodium diethylenetriaminepentaacetate) of 300 g, Dimezone S (1-phenyl-4-hydroxymethyl-4-methyl-3-pyrazolidone) of 300 g ascorbic acid of 4,000 g, sodium sulfite of 1600 g1-phenyl-5-mercaptotetrazole of 7.0 g, mannitol (binder) of 400 g and a compound represented by formula (1) or (2)

in an amount as shown in Table 3, and the mixture was mixed in the mill for 30 min. In stirring granulator commercially available, the resulting mixture was granulated for 10 min. at room temperature by adding 30 ml of water. The resulting granules were dried up at 40° C. for 2 hr. in a fluidized bed drier so that the moisture content of the granules was almost completely removed off.

Granules (B)

Potassium carbonate of 10,000 g and sodium bicarbonate of 2,000 g each were pulverized up in a commercially available mill so as to have an average particle size of 10 μm. To the resulting fine particles, binder mannitol of 800 g was added and mixed in the mill for 30 min. In stirring granulator commercially available, the resulting mixture was granulated for 15 min. at room temperature by adding 30 ml of water. The resulting granules were dried up at 40° C. for 2 hr. in a fluidized bed drier so that the moisture content of the granules was almost completely removed off.

To the thus prepared granules (A) and (B) was added 100 g of sodium laurylsulfate and mixed for 10 min. by making use of a mixer in a room controlled to be not higher than 25° C. and 40% RH. The mixture was compression-tableted so as to have a filling amount of 10 g per tablet, by making use of a tableting machine that was modified model of Tough Press Collect 1527HU manufactured by Kikusui Mfg. Works, Inc to obtain 21,000 tablets with 10 g per tablet and containing ascorbic acid as a developing agent. Developer working solution was prepared by dissolving 24 tablets in water to make 1 liter.

Preparation of Solid Fixer

Granules (C)

Ammonium thiosulfate/sodium thiosulfate (90/10 by weight) of 15,000 g, β-alanine of 1,500 g and sodium acetate of 4,000 g were pulverized up in a commercially available mill so as to have an average particle size of 10 μm. To the resulting fine powder, were added sodium sulfite of 500 g, $Na_2S_2O_5$ of 750 g and binder mannitol of 1,300 g and the mixture was mixed in the mill for 3 min. In stirring granulator commercially available, the resulting mixture was granulated by adding 50 ml of water. The resulting granules were dried up at 40° C. in a fluidized bed drier so that the moisture content of the granules was almost completely removed off.

Granules (D)

Boric acid of 700 g, aluminum sulfate octahydrate of 1,500 g and cinnamic acid of 1200 g were pulverized up in a manner similar to Granule (A). To the resulting fine particles was added sodium hydrogensulfate of 200 g and the resulting mixture was granulated by adding 30 ml of water. The resulting granules were dried up at 40° C. in a fluidized bed drier so that the moisture content of the granules was almost completely removed off.

To the thus prepared granules (C) and (D) was added sodium laurylsulfate of 150 g and mixed for 10 min. by making use of a mixer in a room controlled to be not higher than 25° C. and 40% RH. The mixture was compression-tableted so as to have a filling amount of 10 g per tablet, by making use of a tableting machine that was modified model of Tough Press Collect 1527HU manufactured by Kikusui Mfg. Works, Inc to obtain 26000 tablets. Fixer working solution was prepared by dissolving 28 tablets in water to make 1 liter of fixing solution-1.

Developing solution-1 and Fixing solution-1 prepared as above were each put into the processor, TCX-201 and running process was carried out (total processing time: 60 sec.) according to the following conditions. The developing and fixing temperatures were each set to 36° C. and the photographic material prepared in Example 1 was processed every day, in an amount per day shown in Table 3, for 3 weeks, while developing and fixing solutions were each replenished in an amount of 150 ml per $m^2$ of the photographic material. At the time of starting the running process, there were added, as a starter, acetic acid in an amount that caused the pH of the developing solution to be 10.00 and potassium bromide in an amount that gave a concentration of 12.2 g/l., and the resulting developing solution was employed as a starting solution. Results thereof ware shown in Table 2. In the Table, the sensitivity was defined as a reciprocal of exposure necessary to give an optical density of fog density plus 1.0 and shown as a relative value, based on the sensitivity in the case when developed with a fresh developing solution which contained no compound represented by formula (1) or (2), being 100. Fog and Dm are the same as defined in Example 1. The liquid volume of a developing tank was adjusted to 7.8 l.

TABLE 3

| Developer | Compound (mol/l) | Proc. amt. ($m^2$/day) | R/V | Fog | Sensitivity | Dm | pH | Remark |
|---|---|---|---|---|---|---|---|---|
| 36 | — | Fresh soln. | | 0.185 | 100 | 3.50 | 10.00 | Comp. |
| 37 | — | 6.30 | 0.121 | 0.188 | 96 | 3.40 | 9.90 | Comp. |
| 38 | 1-1 (0.2) | 6.30 | 0.121 | 0.186 | 98 | 3.48 | 9.98 | Inv. |
| 39 | 1-2 (0.2) | 6.30 | 0.121 | 0.186 | 98 | 3.48 | 9.99 | Inv. |
| 40 | Comp.2 (0.2) | 6.30 | 0.121 | 0.188 | 96 | 3.40 | 9.90 | Comp. |
| 41 | Comp.3 (0.2) | 6.30 | 0.121 | 0.188 | 96 | 3.40 | 9.90 | Comp. |
| 42 | 2-1 (0.2) | 6.30 | 0.121 | 0.186 | 98 | 3.48 | 10.00 | Inv. |
| 43 | 2-5 (0.2) | 6.30 | 0.121 | 0.186 | 98 | 3.48 | 10.00 | Inv. |
| 44 | Comp.1 (0.2) | 6.30 | 0.121 | 0.182 | 85 | 3.00 | 10.20 | Comp. |
| 45 | — | 3.00 | 0.058 | 0.188 | 80 | 3.20 | 9.80 | Comp. |
| 46 | 1-1 (0.2) | 3.00 | 0.058 | 0.186 | 95 | 3.38 | 9.96 | Inv. |
| 47 | 1-2 (0.2) | 3.00 | 0.058 | 0.186 | 94 | 3.40 | 9.97 | Inv. |
| 48 | Comp.2 (0.2) | 3.00 | 0.058 | 0.188 | 80 | 3.20 | 9.80 | Comp. |
| 49 | Comp.3 (0.2) | 3.00 | 0.058 | 0.188 | 80 | 3.20 | 9.80 | Comp. |
| 50 | 2-1 (0.2) | 3.00 | 0.058 | 0.185 | 97 | 3.45 | 10.00 | Inv. |
| 51 | 2-5 (0.2) | 3.00 | 0.058 | 0.185 | 98 | 3.47 | 10.00 | Inv. |
| 52 | Comp.1 (0.2) | 3.00 | 0.058 | 0.182 | 72 | 3.00 | 10.10 | Comp. |

As can be seen from Table 3, the use of the developer according to the invention led to superior stability even when subjected to severe running process, and the sensitivity and maximum density were not deteriorated even when processed at a low replenishing rate and even when the mean residence time (day) increased.

Example 3

A photographic material was prepared as below, and solid developer and fixer compositions were each prepared according to the following procedure, and evaluated with respect to the pH variation of a developing solution and photographic performance in running process.

Preparation of Photographic Material (for use in room light handling contact film)

There was prepared by the double jet method a monodisperse silver bromochloride cubic grain emulsion containing 98 mol % chloride and 2 mol % bromide and having an average grain size of 0.15 $\mu$m. During mixing was added $K_3Rh(H_2O)Br_5$ of $7\times10^{-5}$ mol/mol silver. Before subjected to conventional desalting to remove, soluble salts, 4-hydroxy-6-methyl-1,3,3a, 7-tetrazaindene (TAI) was added thereto in an amount of 0.6 g/mol silver (unless otherwise noted, the addition amount is expressed in per mol of silver). The emulsion was raised to a temperature of 60° C., TAI of 60 mg and sodium thiosulfate of 0.75 mg, and then after 60 min., TAI of 600 mg was further added and the temperature was lowered to be set.

To the resulting emulsion were added the following adjuvants so as to have a coating amount per $m^2$, as shown below to prepare coating solutions, and on one side of a subbed support were simultaneously coated an emulsion layer coating solution and a protective layer; and on the other side of the support was coated a backing layer.

| | |
|---|---|
| Emulsion layer | |
| NaOH (0.5N solution) | 4.39 ml/$m^2$ |
| Compound A | 6.53 mg/$m^2$ |
| Saponin | 107 mg/$m^2$ |
| Compound B | 18.5 mg/$m^2$ |
| Compound C | 9.8 mg/$m^2$ |
| Gelatin latex | 480 mg/$m^2$ |
| Poly(sodium styrenesulfonate) | 52.2 mg/$m^2$ |
| Colloidal silica | 20 mg/$m^2$ |
| Lower protective layer | |
| Gelatin | 0.5 g/$m^2$ |
| Dye D (dispersion of solid particles having average size of 0.1 $\mu$m | 62.0 mg/$m^2$ |
| Citric acid | 4.1 mg/$m^2$ |
| Formalin | 1.2 mg/$m^2$ |
| Hardener, K-1 | 0.6 mg/$m^2$ |
| Poly(sodium styrenesulfonate) | 11.0 mg/$m^2$ |
| Upper protective layer | |
| Gelatin | 0.3 g/$m^2$ |
| Compound E | 18.0 mg/$m^2$ |
| Dye D | 48.4 mg/$m^2$ |
| Compound F | 105.0 mg/$m^2$ |
| Compound G | 1.25 mg/$m^2$ |
| Amorphous silica (av, size 1.63 $\mu$m) | 15.0 mg/$m^2$ |
| Amorphous silica (av. size 3.5 $\mu$m) | 21.0 mg/$m^2$ |
| Citric acid | 4.5 mg/$m^2$ |
| Poly(sodium styrenesulfonate) | 11.0 mg/$m^2$ |
| Formalin (in-line addition) | 10 mg/$m^2$ |
| Backing layer | |
| Compound H | 170 mg/$m^2$ |
| Dye D | 30 mg/$m^2$ |
| Compound I | 45 mg/$m^2$ |
| Compound J | 10 mg/$m^2$ |
| Saponin | 111 mg/$m^2$ |
| Compound K | 200 mg/$m^2$ |
| Colloidal silica | 200 mg/$m^2$ |
| Compound L | 35 mg/$m^2$ |
| Compound M | 31 mg/$m^2$ |
| Compound N | 3.1 mg/$m^2$ |
| Polymethylmethacrylate (av. particle size, 5.6 $\mu$m) | 28.9 mg/$m^2$ |
| Glyoxal | 10.1 mg/$m^2$ |
| Citric acid | 9.3 mg/$m^2$ |
| Poly(sodium styrenesulfonate) | 71.1 mg/$m^2$ |
| (the following was in-line addition) | |
| Compound P | 81 mg/$m^2$ |
| Compound Q | 88.2 mg/$m^2$ |
| Calcium acetate | 3.0 mg/$m^2$ |
| Hardener, k-1 | 10 mg/$m^2$ |

-continued
Compound A
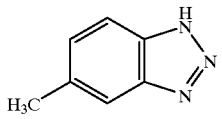
Compound B
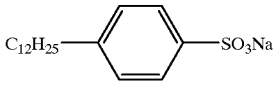
Compound C
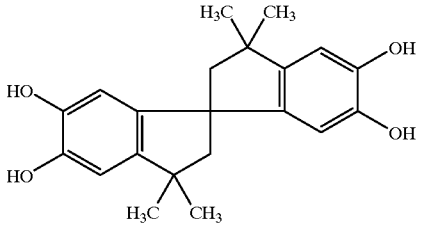
Dye D
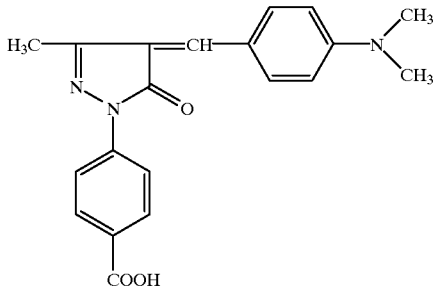
Compound E
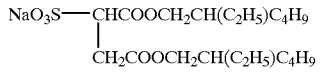
Compound F
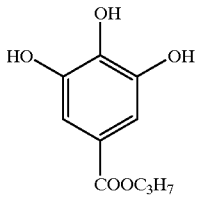
Compound G
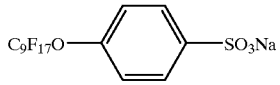

-continued
Compound H
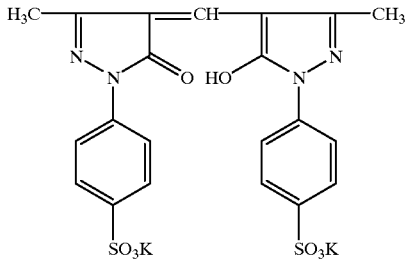
Compound I
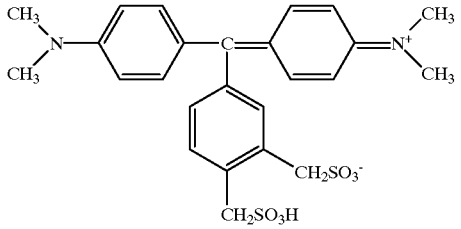
Compound J
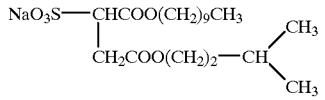
Compound K
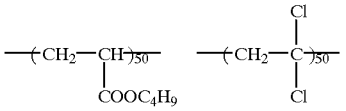
Compound L
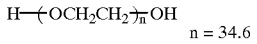
n = 34.6
Compound M
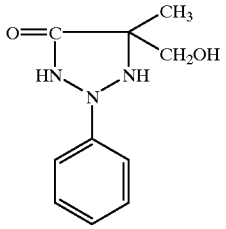
Compound N
$HOCH_2SO_3Na$
Compound P
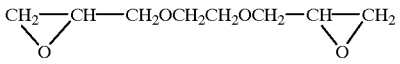
Compound Q
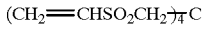

-continued

Gelatin latex

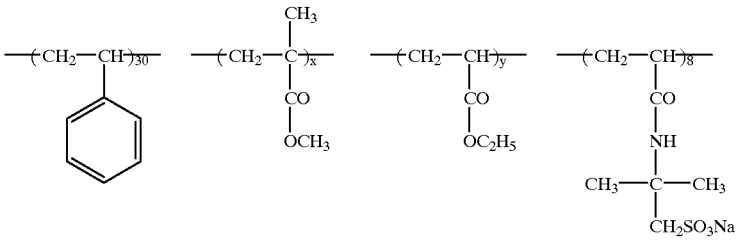

Gelatin:latex = 5:1, x + y = 62

The coating solutions were uniformly coated so that the coating amount of silver and gelatin of the emulsion layer were 2.0 g/m$^2$ and 1.2 g/m$^2$, respectively, and the gelatin coating amount was 2.1 g/m$^2$.

Preparation of Solid Developer

Solid processing composition-E 8-mercaptoadenine of 0.6 g and 5-methylbenzotriazole of 5.5 g each were pulverized up in a commercially available hammermill so as to have an average particle size of 10 $\mu$m. To the resulting fine particles, were added sodium erythorbic acid monohydrate of 600 g, Dimezone S 24.2 g and sodium metabisulfite of 120 g, and the mixture was mixed in the mill for 30 min. In stirring granulator commercially available, the resulting mixture was granulated by adding water of 20 ml and D-sorbit aqueous solution (64 wt %) of 100 g. The resulting granules were dried up at 50° C. for 1 hr. 30 min. in a fluidized bed drier so that the moisture content of the granules was removed off to 1% to obtain granules (E). The granules were further classified by means a dressing machine provided with a 1.0 mm mesh in a room controlled to be not higher than 25° C. and 40% RH. The thus prepared granules was mixed with a compound as shown in Table 4 for 3 min. by making use of a commercially available cross-rotary mixer. The mixture was compression-tableted so as to have a filling amount of 10 g per tablet, by making use of a tableting machine that was modified model of Tough Press Collect 1527HU manufactured by Kikusui Mfg. Works, Inc. to obtain a solid processing composition (E).

Solid processing composition-F

Potassium carbonate and potassium bromide each were pulverized up in a commercially available mill so as to have an average particle size of 10 $\mu$m. In water of 21 ml were dissolved LiOH.$H_2O$ of 0.5 g and 1-phenyl-5-mercaptotetrazole of 0.4 g to make an aqueous solution (b). To the resulting fine particles, were added DTPA.5H (diethylenetriaminepentaacetic acid) of 30 g, potassium bromide pulverized of 20 g, mannitol of 60 g and potassium carbonate pulverized of 30 g, and the mixture was mixed in the mill for 30 min. In stirring granulator commercially available, the resulting mixture was granulated by adding water of 4 ml and the aqueous solution (b). The resulting granules were dried up at 60° C. in a fluidized bed drier so that the moisture content of the granules was removed off to 2% to obtain granules (F). The granules were further classified by means a dressing machine provided with a 1.0 mm mesh in a room controlled to be not higher than 25° C. and 40% RH. The thus prepared granules was mixed with a compound as shown in Table 4 for 3 min. by making use of a commercially available cross-rotary mixer. The mixture was compression-tableted so as to have a filling amount of 10 g per tablet, by making use of a tableting machine described above to obtain a solid processing composition (F).

The thus-prepared solid processing composition-E of 81 tablets and solid processing composition-F of 53 tablets were dissolved in water to make a 10 l solution. The pH was adjusted to 10.70 and the resulting solution was employed as a developer working solution and replenishing solution.

Preparation of fixing solution

As a fixer working solution was employed CFL-881 (available from Konica Corp.), and as a fixer replenishing solution was employed the following.

Preparation of Fixer Replenishing Tablet

| Granule A-part (for working solution of 1 liter) | |
|---|---|
| Ammonium thiosulfate (10% Na salt, product of Hoechst) | 140 g |
| Sodium metabisulfite | 7.5 g |
| Sodium acetate | 40 g |
| Pineflow (trade name, Matsugaya Kagaku) | 11.8 g |

The mixture was mixed in a bantom mill for 30 min. In stirring granulator commercially available, the resulting mixture was granulated for 10 min. at room temperature and the resulting granules were dried up at 40° C. for 2 hr. in a fluidized bed drier to obtain granules (A-part).

| Granule B-part (for working solution of 1 liter) | |
|---|---|
| Boric acid | 10 g |
| Tartaric acid | 3 g |
| Sodium hydrogensulfate | 26.5 g |
| Aluminium sulfate (octahydrate) | 15.8 g |
| D-mannitol (trade name, available from Kao) | 4.4 g |
| N-lauroyltauline (trade name, available from Nikko Chemical) | 2 g |
| Demol (trade name, available from Kao) | 5 g |

The mixture was mixed in a bantom mill for 30 min. In stirring granulator commercially available, the resulting mixture was granulated for 10 min. at room temperature and the resulting granules were dried up at 40° C. for 2 hr. in a fluidized bed drier to obtain granules (B-part).

The mixture was mixed in the mill for 3 min. In stirring granulator commercially available, the resulting mixture was granulated for 1 min. at room temperature by adding 30 ml of water. The resulting granules were dried up at 40° C. for 2 hr. in a fluidized bed drier so that the moisture content of the granules was almost completely removed off. The granules were further classified by means a dressing machine provided with a 1.0 mm mesh. The thus prepared granules (DB) was mixed for 10 min. by making use of a mixer in a room controlled to be not higher than 25° C. and 40% RH. The part-A and part B were completely mixed for 10 min. and the mixture was compression-tableted so as to have a filling amount of 10.6 g per tablet, by making use of a tableting machine, Machina UD)DFE3040 manufactured by Machina Inc. to obtain 25 tablets with a diameter of 30 mm and thickness of 10 mm. These 25 tablets were dissolved in water to make a fixer working solution of 1 liter. The pH was adjusted to 4.20.

Processing condition:

Processor: GR-26SR (available from Konica Corp.)

| | | |
|---|---|---|
| Developing | 35° C. | 15 sec. |
| Fixing | 34° C. | 10 sec. |
| Washing | Ordinary Temp. | 10 sec. |
| Drying | 45° C. | 10 sec. |

Running process test was carried out using the above-described developing solution, fixing solution and process GR-26SR (available from Konica Corp.). Thus, the photographic material was processed every day, in an amount per day shown in Table 4, for 3 weeks, while developing and fixing solutions were each replenished in an amount of 100 ml per $m^2$ of the photographic material. At the time of starting the running process, there were added, as a starter, acetic acid in an amount that caused the pH of the developing solution to be 10.40 and potassium bromide in an amount that gave a concentration of 12.2 g/l., and the resulting developing solution was employed as a starting solution. Results thereof ware shown in Table 4. In the Table, the sensitivity was defined as a reciprocal of exposure necessary to give an optical density of fog density plus 1.0 and shown as a relative value, based on the sensitivity in the case when developed with a fresh developing solution which contained no compound represented by formula (1) or (2), being 100. Fog and Dm are the same as defined in Example 1. The liquid volume of a developing tank was adjusted to 27 l.

TABLE 4

| Developer | Compound (mol/l) | | Proc. amt. ($m^2$/day) | R/V | Fog | Sensitivity | Dm | pH | Remark |
|---|---|---|---|---|---|---|---|---|---|
| 53 | — | | Fresh soln. | | 0.035 | 100 | 5.00 | 10.40 | Comp. |
| 54 | — | | 33.00 | 0.122 | 0.04 | 96 | 4.50 | 10.30 | Comp. |
| 55 | 2-1 | (0.25) | 33.00 | 0.122 | 0.36 | 98 | 5.00 | 10.37 | Inv. |
| 56 | 2-2 | (0.25) | 33.00 | 0.122 | 0.036 | 98 | 5.00 | 10.38 | Inv. |
| 57 | Comp.2 | (0.25) | 33.00 | 0.122 | 0.038 | 96 | 4.60 | 10.20 | Comp. |
| 58 | Comp.3 | (0.25) | 33.00 | 0.122 | 0.038 | 96 | 4.45 | 10.20 | Comp. |
| 59 | 1-1 | (0.25) | 33.00 | 0.122 | 0.035 | 98 | 5.00 | 10.40 | Inv. |
| 60 | 1-5 | (0.25) | 33.00 | 0.122 | 0.035 | 98 | 5.00 | 10.40 | Inv. |
| 61 | Comp.1 | (0.25) | 33.00 | 0.122 | 0.032 | 85 | 4.00 | 10.65 | Comp. |
| 62 | — | | 15.00 | 0.056 | 0.042 | 80 | 4.15 | 10.10 | Comp. |
| 63 | 2-1 | (0.25) | 15.00 | 0.056 | 0.036 | 95 | 4.90 | 10.35 | Inv. |
| 64 | 2-2 | (0.25) | 15.00 | 0.056 | 0.036 | 94 | 4.95 | 10.37 | Inv. |
| 65 | Comp.2 | (0.25) | 15.00 | 0.056 | 0.042 | 80 | 4.15 | 10.10 | Comp. |
| 66 | Comp.3 | (0.25) | 15.00 | 0.056 | 0.042 | 80 | 4.15 | 10.10 | Comp. |
| 67 | 1-1 | (0.25) | 15.00 | 0.056 | 0.035 | 98 | 5.00 | 10.40 | Inv. |
| 68 | 1-5 | (0.25) | 15.00 | 0.056 | 0.035 | 98 | 5.00 | 10.40 | Inv. |
| 69 | Comp.1 | (0.25) | 15.00 | 0.056 | 0.03 | 72 | 4.05 | 10.45 | Comp. |

Example 4

Preparation of Photographic Material

Preparation of Silver halide emulsion A

There was prepared by the double jet method a monodisperse silver bromochloride core grains containing 70 mol % chloride and having an average grain thickness of 0.05 μm and average grain diameter of 0.15 μm. During mixing was added $K_3RhCl_6$ of $8\times10^{-8}$ mol/mol silver. The core grains were further shelled by the double jet method, in which $K_2IrCl_6$ of $3\times10^{-7}$ mol/mol silver was added. The resulting emulsion was comprised of core/shell type, monodisperse (variation coefficient of 10%) silver iodobromochloride (chloride of 90 mol % and iodide of 0.2 mol %) tabular grains having an average thickness of 0.10 μm, average diameter of 0.25 m and (100) major faces. Thereafter, the emulsion was desalted using modified gelatin described in JP-A 2-280139 (one in which an amino group is substituted by phenylcarbamoyl,for example, exemplified compound G-8 described in JP-A 2-280139). After desalting, the EAg of the emulsion was 190 mV at 50° C. To the resulting emulsion was added 4-hydroxy-6-methyl-1,3,3a,7-tetrazaindene of $1\times10^{-3}$ mol/mol Ag, and after adjusting the pH and EAg to 5.6 and 123 mV, respectively, with potassium bromide and citric acid, the emulsion was chemically ripened at 60° C. by adding chloroauric acid of $2\times10^{-5}$ mol/mol Ag and sulfur single body of $3\times10^{-6}$ mol/mol Ag, until reaching the maximum sensitivity. After completing the ripening were added 4-hydroxy-6-methyl-1,3,3a,7-tetrazaindene of $2\times10^{-3}$ mol/mol Ag, 1-phenyl-5-mercaptotetrazole of $3\times10^{-4}$ mol/mol Ag and gelatin.

Preparation of Silver halide emulsion B

There was prepared by the double jet method a monodisperse silver iodobromochloride core grains containing 60 mol % chloride and 2.5 mol % iodide and having an average grain thickness of 0.05 μm and average grain diameter of 0.15 μm. During mixing was added $K_3Rh(H_2O)Cl_5$ of $2\times10^{-8}$ mol/mol silver. The core grains were further shelled by the double jet method, in which $K_2IrCl_6$ of $3\times10^{-7}$ mol/mol silver was added. The resulting emulsion was comprised of core/shell type, monodisperse (variation coefficient of 10%) silver iodobromochloride (chloride of 90 mol % and iodide of 0.5 mol %) tabular grains having an average thickness of 0.10 μm, average diameter of 0.42 m and (100) major faces. Thereafter, the emulsion was desalted using modified gelatin described in JP-A 2-280139 (one in which an amino group is substituted by phenylcarbamoyl, for example, exemplified compound G-8 described in JP-A 2-280139). After desalting, the EAg of the emulsion was 180 mV at 50° C. To the resulting emulsion was added 4-hydroxy-6-methyl-1,3,3a,7-tetrazaindene of $1\times10^{-3}$ mol/mol Ag, and after adjusting the pH and EAg to 5.6 and 123 mV, respectively, with potassium bromide and citric acid, the emulsion was chemically ripened at 60° C. by adding chloroauric acid of $2\times10^{-5}$ mol/mol Ag and N,N,N'- trimethyl-N'-heptafluoroselenourea of $3\times10^{-5}$ mol/mol Ag, until reaching the maximum sensitivity. After completing the ripening were added 4-hydroxy-6-methyl-1,3,3a,7-tetrazaindene of $2\times10^{-3}$ mol/mol Ag, 1-phenyl-5-mercaptotetrazole of $3\times10^{-4}$ mol/mol Ag and gelatin.

Preparation of Photographic Material (for use in plate-making scanner with He-Ne laser light)

On one side of a subbed support were simultaneously coated a gelatin subbing layer of the following formula 1 with a gelatin coating weight of 0.5 g/m$^2$; thereon, a silver halide emulsion layer-1 of formula 2 with coating weights of silver and gelatin of 1.5 g/m$^2$ and 0.5 g/m$^2$, respectively; further thereon, an interlayer of formula 3 with a coating weight of gelatin of 0.3 g/m$^2$; further thereon, a silver halide emulsion layer-2 of formula 4 with coating weights of silver and gelatin of 1.4 g/m$^2$ and 0.4 g/m$^2$, respectively; and further thereon, a protective layer of formula 5 with a coating weight of 0.6 g/m$^2$. On the other side of the subbed support, a backing layer of formula 6 with a gelatin coating weight of 0.6 g/m$^2$ and thereon, a hydrophobic polymer layer of formula 7; and further thereon, a backing protective layer of formula 8 with a gelatin coating weight of 0.4 g/m$^2$ were coated simultaneously with the emulsion layer-side, and a photographic material sample was thus prepared.

| | |
|---|---|
| Formula 1 (gelatin subbing layer) | |
| Gelatin | 0.5 g/m$^2$ |
| Dye AD-1, dispersion of solid particles (with an average size 0.1 μm) | 25 mg/m$^2$ |
| Poly(sodium styrenesulfonate) | 10 mg/m$^2$ |
| S-1 (sodium i-amyl-n-decyl-sulfosuccinate) | 0.4 mg/m$^2$ |
| Formula 2 (silver halide emulsion layer-1) | |
| Silver halide emulsion A | 1.5 g/m$^2$, based on silver |
| Dye AD-8, dispersion of solid particles (with an average size 0.1 μm) | 20 mg/m$^2$ |
| Cyclodextrin (hydrophilic polymer) | 0.5 mg/m$^2$ |
| Sensitizing dye d-1 | 5 mg/m$^2$ |
| Sensitizing dye d-2 | 5 mg/m$^2$ |
| Hydrazine derivative H-7 | 20 mg/m$^2$ |
| Redox compound: RE-1 | 20 mg/m$^2$ |
| Compound e | 100 mg/m$^2$ |
| Latex polymer f | 0.5 mg/m$^2$ |
| Hardener g | 5 mg/m$^2$ |
| S-1 | 0.7 mg/m$^2$ |
| 2-mercapto-6-hydroxypurine | 5 mg/m$^2$ |
| EDTA | 30 mg/m$^2$ |
| Colloidal silica (av. particle size 0.05 μm) | 10 mg/m$^2$ |
| Formula 3 (interlayer) | |
| Gelatin | 0.3 g/m$^2$ |
| S-1 | 2 mg/m$^2$ |
| Formula 4 (silver halide emulsion layer-2) | |
| Silver halide emulsion B | 1.4 g/m$^2$, based on silver |
| Sensitizing dye d-1 | 3 mg/m$^2$ |
| Sensitizing dye d-2 | 3 mg/m$^2$ |
| Hydrazine derivative H-20 | 20 mg/m$^2$ |
| Nucleation accelerator Nb-12 | 40 mg/m$^2$ |
| Redox compound RE-2 | 20 mg/m$^2$ |
| 2-Mercapto-6-hydroxypurine | 5 mg/m$^2$ |
| EDTA | 20 mg/m$^2$ |
| Latex polymer f | 0.5 g/m$^2$ |
| S-1 | 1.7 mg/m$^2$ |
| Formula 5 (Emulsion protective layer) | |
| Gelatin | 0.6 mg/m$^2$ |
| Dye AD-5, dispersion of solid particles (with an average size 0.1 μm) | 40 mg/m$^2$ |
| S-1 | 12 mg/m$^2$ |
| Matting agent: monodisperse silica with average particle size of 3.5 μm | 25 mg/m$^2$ |
| Nucleation accelerator Na-3 | 40 mg/m$^2$ |
| 1,3-vinylsulfonyl-2-propanol | 40 mg/m$^2$ |
| Surfactant h | 1 mg/m$^2$ |
| Colloidal silica (av. particle size 0.05 μm) | 10 mg/m$^2$ |
| Hardener K-1 | 30 mg/m$^2$ |
| Formula 6 (backing layer) | |
| Gelatin | 0.6 g/m$^2$ |
| S-1 | 5 mg/m$^2$ |
| Latex polymer f | 0.3 g/m$^2$ |
| Colloidal silica (av. particle size 0.05 μm) | 70 mg/m$^2$ |
| Poly(sodium styrenesulfonate) | 20 mg/m$^2$ |
| Compound i | 100 mg/m$^2$ |

-continued

| | |
|---|---|
| Formula 7 (hydrophobic polymer layer) | |
| Latex (methylmethacrylate:acrylic acid = 97:3) | 1.0 g/m$^2$ |
| Hardener g | 6 mg/m$^2$ |
| Formula 8 (backing protective layer) | |
| Gelatin | 0.4 mg/m$^2$ |
| Matting agent: monodisperse poly(methyl methacrylate) particles with av. size of 5 $\mu$m | 50 mg/m$^2$ |
| Sodium di-(2-ethylhexyl)-sulfosuccinate | 10 mg/m$^2$ |
| Surfactant h | 1 mg/m$^2$ |
| Dye k | 20 mg/m$^2$ |
| H—$(OCH_2CH_2)_{68}$—OH | 50 mg/m$^2$ |
| Hardener K-1 | 20 mg/m$^2$ |

Compound i

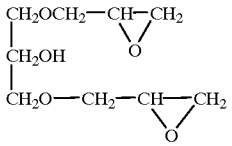

Dye k

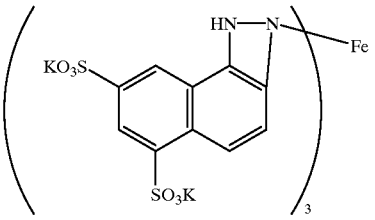

H-7

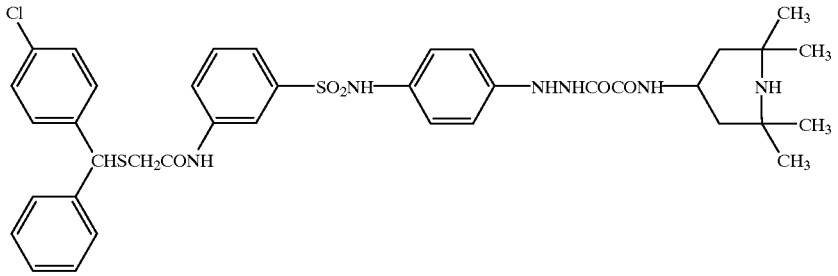

H-20

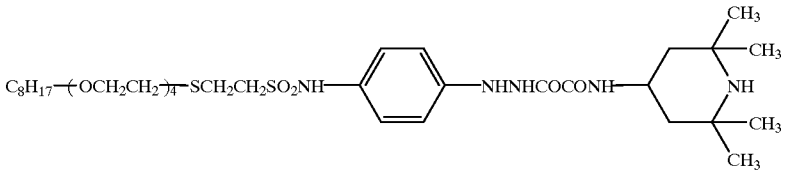

-continued
RE-1
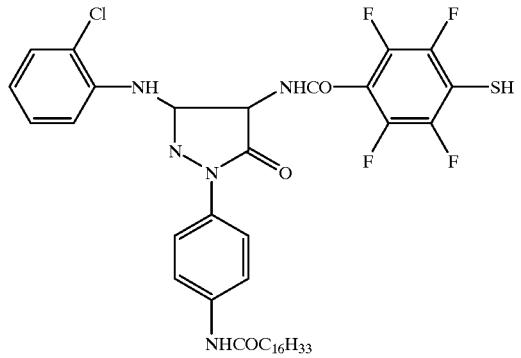
RE-2
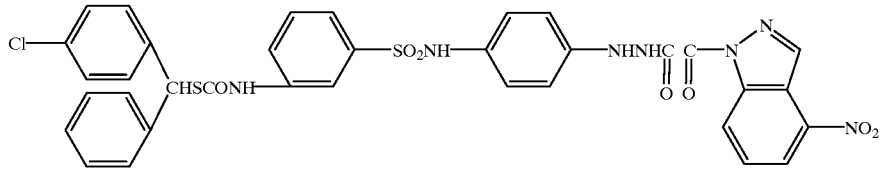
Na-3
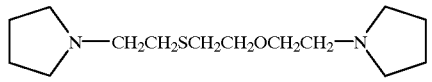
Nb-12
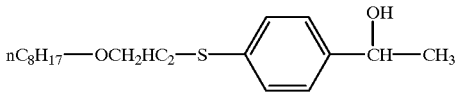
K-1
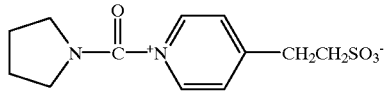
Sensitizing dye d-1
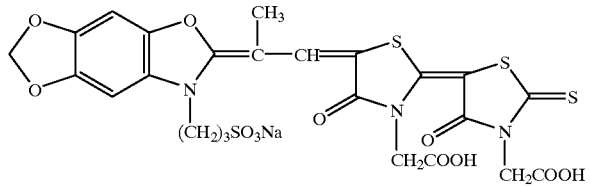
Sensitizing dye d-2
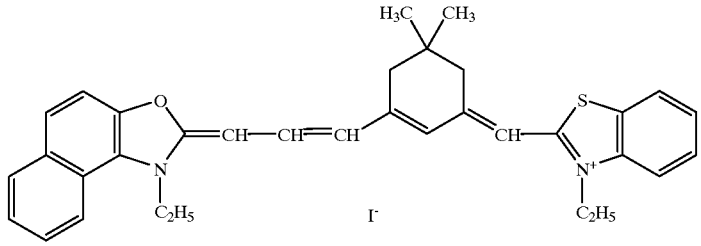
Compound e
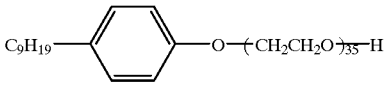

-continued
Latex polymer f
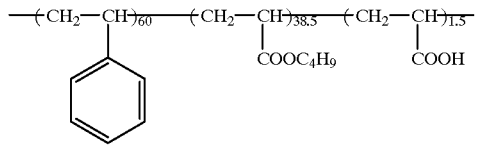
Hardener g
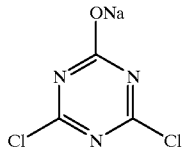
Surfactant h
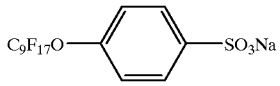
AD-1
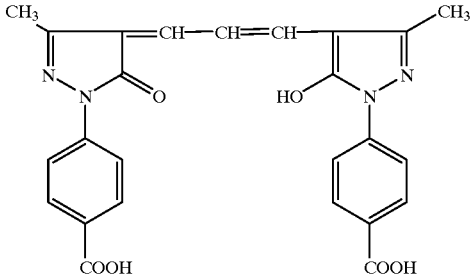
AD-5
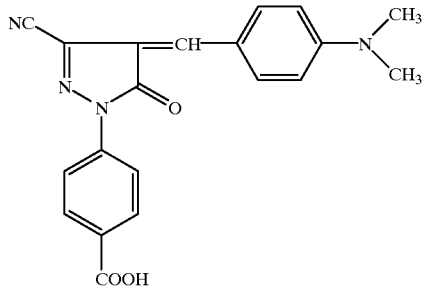
AD-8
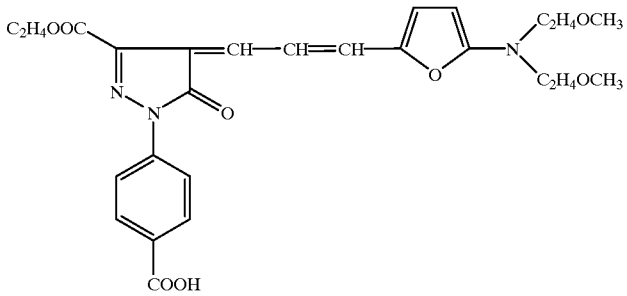
Preparation of Processing Solution
As a developer starting solution was employed CDM-681, and a developer replenishing solution was prepared as follows. Developer replenishing solution (for 1 liter)

| | |
|---|---|
| Water | 327 g |
| DTPA.5Na (40% aqueous solution) | 10.86 g |
| Sodium sulfite | 66.58 g |
| Potassium bromide | 2 g |
| Sodium carbonate | 8 g |
| Potassium carbonate | 44.58 g |
| DEG | 70 g |
| 8-Mercaptoadenine | 0.2 g |
| Sodium erythorbate monohydrate | 60 g |
| Benzotriazole | 0.26 g |
| Dimezone S | 1.1 g |
| 1-phenyl-5-mercaptotetrazole | 0.08 g |
| KOH (48.6% aqueous solution) | 14.6 g |
| Water to make | 1 liter |
| The pH was adjusted to 10.40. | |

As a fixer starting solution was employed CFL-881, and a fixer replenishing solution was prepared as follows.

Fixer Replenishing Solution(for 1 liter)

| | |
|---|---|
| Ammonium thiosulfate | 1.0 mol |
| Water | 242 ml |
| Sodium sulfite | 22 g |
| Boric acid | 9.78 g |
| Sodium acetate trihydrate | 32.27 g |
| Acetic acid (90% aqueous solution) | 16.78 g |
| Tartaric acid | 3 g |
| Aluminum sulfate (27% aqueous solution) | 32.93 g |
| Water to make | 1 liter |
| Salt concentration (mol/l) | 1.78 mol/l |
| The pH was adjusted to 4.70. | |

Processing condition:

Processor: GR-680 (available from Konica Corp.)

| | | |
|---|---|---|
| Developing | 35° C. | 30 sec. |
| Fixing | 35° C. | 20 sec. |
| Washing | Ordinary Temp. | 15 sec. |
| Drying | 50° C. | 15 sec. |

Replenishing rate:

Developing solution=10 ml per (10×12 inch)-sheet

Fixing solution=17.5 ml per (10×12 inch)-sheet

Running process test was carried out according to the above conditions. Thus, the photographic material was processed every day, in an amount per day shown in Table 5, for 3 weeks, while developing and fixing solutions were respectively replenished in an amount of 130 ml and 230 ml per $m^2$ of the photographic material. At the time of starting the running process, there were added, as a starter, acetic acid in an amount that caused the pH of the developing solution to be 10.40 and potassium bromide in an amount that gave a concentration of 12.2 g/l., and the resulting developing solution was employed as a starting solution. Results thereof ware shown in Table 5. In the Table, the sensitivity was defined as a reciprocal of exposure necessary to give an optical density of fog density plus 1.0 and shown as a relative value, based on the sensitivity in the case when developed with a fresh developing solution which contained no compound represented by formula (1) or (2), being 100. Fog and Dm are the same as defined in Example 2. The liquid volume of a developing tank was adjusted to 40 liters.

TABLE 5

| Developer | Compound (mol/l) | Proc. amt. ($m^2$/day) | R/V | Fog | Sensitivity | Dm | pH* | Remark |
|---|---|---|---|---|---|---|---|---|
| 70 | — | Fresh soln. | | 0.035 | 100 | 5.00 | 10.40 | Comp. |
| 71 | — | 45.00 | 0.146 | 0.04 | 96 | 4.50 | 10.30 | Comp. |
| 72 | 2-1 (0.3) | 45.00 | 0.146 | 0.036 | 98 | 5.00 | 10.40 | Inv. |
| 73 | 2-2 (0.3) | 45.00 | 0.146 | 0.036 | 98 | 5.00 | 10.40 | Inv. |
| 74 | Comp.2 (0.3) | 45.00 | 0.146 | 0.038 | 96 | 4.50 | 10.20 | Comp. |
| 75 | Comp.3 (0.3) | 45.00 | 0.146 | 0.038 | 96 | 4.50 | 10.20 | Comp. |
| 76 | 1-1 (0.3) | 45.00 | 0.146 | 0.035 | 98 | 5.00 | 10.40 | Inv. |
| 77 | 1-5 (0.3) | 45.00 | 0.146 | 0.035 | 98 | 5.00 | 10.40 | Inv. |
| 78 | Comp.1 (0.3) | 45.00 | 0.146 | 0.032 | 85 | 4.00 | 10.65 | Comp. |
| 79 | — | 15.00 | 0.049 | 0.043 | 77 | 4.20 | 10.15 | Comp. |
| 80 | 2-1 (0.3) | 15.00 | 0.049 | 0.036 | 95 | 4.90 | 10.35 | Inv. |
| 81 | 2-2 (0.3) | 15.00 | 0.049 | 0.036 | 94 | 4.90 | 10.37 | Inv. |
| 82 | Comp.2 (0.3) | 15.00 | 0.049 | 0.043 | 77 | 4.20 | 10.15 | Comp. |
| 83 | Comp.3 (0.3) | 15.00 | 0.049 | 0.043 | 77 | 4.20 | 10.15 | Comp. |
| 84 | 1-1 (0.3) | 15.00 | 0.049 | 0.035 | 98 | 5.00 | 10.40 | Inv. |
| 85 | 1-5 (0.3) | 15.00 | 0.049 | 0.035 | 98 | 5.00 | 10.40 | Inv. |
| 86 | Comp.1 (0.3) | 15.00 | 0.049 | 0.035 | 72 | 3.80 | 10.45 | Comp. |

As can be seen from Tables 4 and 5, according to the processing method of the invention, stable running processability was achieved, even when different photographic materials were processed. Further, when the amount of film to be processed is increase, effects of the invention was proved to be further markedly displayed.

What is claimed is:

1. A developer composition comprising a reductone, a saccharide, and a compound represented by the following formula (2):

formula 2

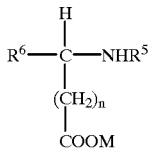

wherein $R^5$ and $R^6$ independently represent a hydrogen atom, a methyl group, a hydroxymethyl group or a carboxymethyl group; M represents a hydrogen atom, an alkaline metal atom or an ammonium group; and n is an integer of 0, 1 or 2, and wherein the developer composition is in the form of a tablet.

2. The developer composition of claim 1, wherein $R^5$ and $R^6$ represent a hydrogen atom.

3. The developer composition of claim 1, wherein wherein $R^5$ and $R^6$ independently represents a hydrogen atom; M represents a hydrogen atom; and n is 0.

4. The developer composition, of claim 1 wherein said reductone is a compound represented by the following formula (A):

formula (A)

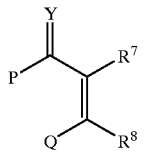

wherein $R^7$ and $R^8$ independently represent a hydroxy group, an amino group, an acylamino group, an alkylsulfonylamino group, an arylsulfonylamino group, an alkoxycarbonylamino group, a mercapto group or an alkylthio group; P and Q independently represent a hydroxy group, a carboxy group, an alkoxy group, a hydroxyalkyl group, a carboxyalkyl group, a sulfo group, a sulfoalkyl group, an amino group, an aminoalkyl group, an alkyl group or an aryl group, or P and Q combine with each other to form a 5 to 8-membered ring; Y represents =O or $=NR^9$, in which $R^9$ represents a hydrogen atom, a hydroxy group, an alkyl group, an acyl group, a hydroxyalkyl group, a sulfoalkyl group or a carboxyalkyl group.

5. The developer composition of claim 1, wherein the reductone is contained in an amount of 3 to 90% by weight, based on the developer composition.

6. The developer composition of claim 1, wherein the compound represented by formula (2) is contained in an amount of $1\times10^{-4}$ to $3\times10^{-2}$ mol per g of the developer composition.

7. The developer composition of claim 1, wherein the saccharide is mannitol or D-sorbit.

8. The developer composition of claim 1, wherein the saccharide is a dextrin or a sugar alcohol.

9. The developer composition of claim 1, wherein the reductone is contained in an amount of 10 to 80% by weight, based on the developer composition.

10. The developer composition of claim 1, wherein the compound represented by formula (2) is contained in an amount of $3\times10^{-4}$ to $2\times10^{-3}$ mol per g of the developer composition.

* * * * *